United States Patent [19]

Matsuo et al.

[11] Patent Number: 4,730,176

[45] Date of Patent: Mar. 8, 1988

[54] ELECTROMAGNET HAVING A PIVOTED POLARIZED ARMATURE

[75] Inventors: Kenichi Matsuo; Muneo Nakata; Kazuhiro Oota; Mitukazu Hori; Tooru Oohara; Makoto Yazawa, all of Iida, Japan

[73] Assignee: Omron Tateisi Electronics Co., Kyoto, Japan

[21] Appl. No.: 13,296

[22] Filed: Feb. 10, 1987

[30] Foreign Application Priority Data

Feb. 10, 1986 [JP] Japan ..... 61-27436
Mar. 17, 1986 [JP] Japan ..... 61-39408[U]

[51] Int. Cl.[4] ..... H01F 7/08

[52] U.S. Cl. ..... 335/230; 335/78; 335/84

[58] Field of Search ..... 335/78, 79, 80, 81, 335/84, 229, 230, 234

[56] References Cited

U.S. PATENT DOCUMENTS 4,142,166 2/1979 Arnoux ..... 335/230 X

FOREIGN PATENT DOCUMENTS 55-66361 5/1980 Japan ..... 335/230
56-43580 10/1981 Japan ..... 335/80
57-185151 11/1982 Japan ..... 335/202
180006 10/1983 Japan ..... 335/230
60-35438 2/1985 Japan ..... 335/230
61-76920 5/1986 Japan ..... 335/230

*Primary Examiner*—George Harris
*Attorney, Agent, or Firm*—Wegner & Bretschneider

[57] ABSTRACT

An electromagnet device is assembled to, e.g., an electromagnetic relay. This device comprises a movable assembly which is swingably supported and a core in which a coil is wound around a part thereof. The movable assembly has two magnetic plates arranged so as to face each other with a distance and one permanent magnet arranged between those magnetic plates. Each magnetic plate has operating portions at both end portions thereof in which magnetic poles appear due to the permanent magnet. The core has two end portions which are arranged so as to respectively face the operating portions of the magnetic plates. At least one of the operating portions which faces at least one of the end portions of the core is formed at the edge surface of the magnetic plate.

3 Claims, 11 Drawing Figures

ELECTROMAGNET HAVING A PIVOTED POLARIZED ARMATURE

BACKGROUND OF THE INVENTION

1. Field of the Invention

The present invention relates to an electromagnet device and, more particularly, to an electromagnet device which is assembled in, for example, an electromagnetic relay.

2. Description of the Prior Art

The electromagnet device assembled in the electromagnetic relay is used to move the movable contact member of the electromagnetic relay between the ON position and the OFF position. At the ON position, the movable contact attached to the movable contact member come into contact with a fixed contact. At the OFF position, the movable contact is removed from the fixed contact. To drive the movable contact member, the electromagnet device has a pivotably movable assembly. The swing motion of the movable assembly is transferred to the movable contact. The movable assembly is moved by the attractive force and the repulsive force of the electromagnet. The movable assemble assembly comprises: two magnetic plates (iron plates) arranged so as to face each other with an interval; a supporting member, disposed between those two magnetic plates, for swingably supporting the magnetic plates at almost the central positions in their longitudinal directions; and two permanent magnets arranged at the positions on both sides of the supporting member so as to be sandwiched between the two magnetic plates. On the other hand, a substantially C-shaped core is provided. A coil is wound around a part of the core. Each end of the core is inserted between the end portions of the two magnetic plates so as not to come into contact with those end portions of the magnetic plates. The movable assembly is driven so as to swing around the supporting member as a center by the attractive or repulsive force between the magnetic poles which are developed at both ends of the core in dependence on the direction of a current flowing through the coil and the magnetic poles which are generated in the magnetic plates by the permanent magnets.

According to such a conventional electromagnet device, the magnetic efficiency is high because the attractive or repulsive forces act at four positions in the movable assembly. However, since two permanent magnets are necessary to form magnetic circuits, there is such a problem that the device increases in size. In addition, since each end portion of the core is disposed so as to be sandwiched between the two magnetic plates in the contactless state, if the end portions of the core are moved to approach (or removed from) one of the two magnetic plates in order to adjust the magnitude of the attractive or repulsive force which acts only between one magnetic plate and the core, the distance between end portions of the core and the other magnetic plate increases (or decreases), so that the attractive or repulsive force which acts between the core and the other magnetic plate also changes. Consequently, it is impossible to perform such an adjustment.

SUMMARY OF THE INVENTION

It is an object of the present invention to miniaturize an electromagnet device and to make it possible to relatively easily adjust the driving force of the electromagnet device.

According to the present invention, an electromagnet device comprises: a movable assembly which is swingably supported and has two magnetic plates arranged so as to face each other with a predetermined interval and one permanent magnet sandwiched between those magnetic plates, each of the magnetic plates having operating portions adapted to generate the magnetic poles at the locations near both end portions of each magnetic plate; and a core having two end portions and around a part of which a coil is wound, both of these end portions respectively facing the operating portions of the magnetic plates. At least one of the operating portions which faces at least one of the end portions of the core is formed at the edge surface of the magnetic plate.

According to the present invention, the attractive or repulsive forces can be produced at four positions by one permanent magnet, so that the apparatus can be miniaturized. On the other hand, the magnetic plates and the core are arranged in such a manner that at least one operating portion of the magnetic plate is formed at the edge surface. This means that at least one end portion of the core is not inserted between the two magnetic plates. Therefore, the problems as in the conventional device are not caused. The interval between the operating portion of one magnetic plate and the end portion of the core can be relatively easily adjusted.

Preferable embodiments of the present invention will be described in detail hereinbelow with reference to the drawings.

DESCRIPTION OF THE PREFERRED EMBODIMENTS

Figure 1:
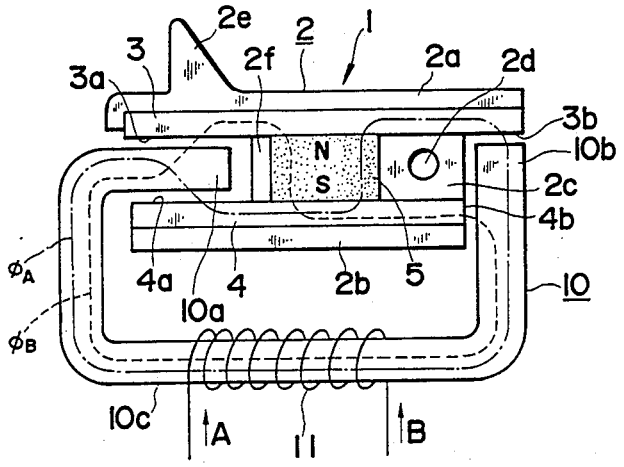
FIG. 1 is a plan view showing the first embodiment of the invention.

FIG. 1 shows the first embodiment of the present invention.

A movable assembly 1 comprises: an insulation supporting member 2; two iron plates 3 and 4; and one permanent magnet 5. The insulation supporting member 2 comprises: side portions 2*a* and 2*b;* and a fulcrum portion 2*c* and a connecting portion 2*f* both for integrally coupling the side portions 2*a* and 2*b*. The side portion 2*a* is formed with a projection 2*e* to drive a movable contact member which is included in an electromagnetic relay. The iron plates 3 and 4 are sandwiched between the side portion 2*a* and 2*b*, and the fulcrum portion 2*c* and the connecting portion 2*f*, respectively, so that the iron plates are arranged in parallel so as to face each other with a constant interval. The single permanent magnet 5 is inserted and fixed between the iron plates 3 and 4 and between the portions 2*c* and 2*f*. The iron plates 3 and 4 come into contact with the magnetic poles N and S of the permanent magnet 5. A hole 2*d* is formed in the fulcrum portion 2*c*. By inserting a supporting axis of a base, which will be explained hereinafter, into the hole 2*d*, the movable assembly 1 is rotatably supported.

An iron core 10 is of a substantially C shape. A coil 11 is wound around a base portion 10*c* of the iron core 10. One end portion 10*a* of the iron core 10 is substantially perpendicularly bent and inserted into the space between one end portion of the iron plate 3 and one end portion of the iron plate 4 on the same side. The side surfaces of those end portions of the iron plates 3 and 4 which face one end portion 10*a* serve as operating portions 3*a* and 4*a* on which the attractive or repulsive forces act. The other end portion 10*b* of the iron core 10 is extended straight. The edge surface of the other end portion 10*b* faces a side surface 3*b* of the other end portion of the iron plate 3. An edge surface 4*b* of the other end portion of the iron plate 4 faces the side surface of the other end portion 10*b* of the iron core 10. The side surface 3*b* and edge surface 4*b* of those edge portions also serve as the operating portions.

With the above constitution, when a current is supplied to the coil 11 in the direction indicated by an arrow A, the N pole is developed in one end portion 10*a* of the iron core 10 and the S pole is produced in the other end portion 10*b*. Therefore, on the basis of the relation with the magnetic poles of the permanent magnet 5, the repulsive force is caused between the end portion 10*a* and the operating portion 3*a*; the attractive force is produced between the end portion 10*a* and the operating portion 4*a*; the attractive force is generated between the other end portion 10*b* and the operating portion 3*b*; and the repulsive force is developed between the other end portion 10*b* and the operating portion 4*b*. Thus, the movable assembly 1 rotates clockwise in FIG. 1 around the hole 2*d* as the rotational center. Consequently, a magnetic circuit $\phi_A$ is formed as shown by a dot and dash line.

On the contrary, when a current is supplied to the coil 11 in the direction indicated by an arrow B, the S pole is excited in the end portion 10*a* of the iron core 10 and the N pole is excited in the other end portion 10*b*. Therefore, the attractive forces and repulsive forces are generated oppositely to the above and the movable assembly 1 is rotated counterclockwise. Thus, a magnetic circuit $\phi_B$ is formed as shown by a broken line.

Two magnetic circuits $\phi_A$ and $\phi_B$ are formed in accordance with the direction of the current flowing through the coil 11 as mentioned above. The attractive and repulsive portions (operating portions) are formed at total four positions, so that the magnetic efficiency and the sensitivity are maintained in high degree. In addition, it is enough to use only one permanent magnet 5 and the apparatus is miniaturized. Further, since the iron plates 3 and 4 and the iron core 10 can be also formed by the pressing works, the machining can be easily performed. These advantages are also similar in the other embodiments which will be explained hereinafter.

The interval between the end portion 10*a* of the iron core 10 and the operating portion 3*a* is the same as the interval between the end portion 10*a* and the operating portion 4*a*. The interval between the other end portion 10*b* and the operating portion 3*b* is also the same as the interval between the other end portion 10*b* and the operating portion 4*b*. Therefore, so long as the current values when the current flows through the coil 11 in the A direction and in the B direction are the same, the same forces (attractive forces and repulsive forces) act when the movable assembly 1 rotates clockwise (hereinafter, referred to as the case A) and when it rotates counterclockwise (hereinafter, referred to as the case B).

For example, a consideration will now be made with respect to such a situation as to adjust (namely, increase or decrease) the forces which act in the case B, while the forces which act in the case A are kept to almost the same value. In this case, it is assumed that the current values in the A and B directions are held to the same value. For example, if the interval between the end portion 10*a* of the iron core 10 and the operating portion 3*a* is narrowed, the interval between the end portion 10*a* and the operating portion 4*a* will be widened. Therefore, the above-mentioned condition is not satisfied. According to the present invention, it is sufficient to change the intervals among the other end portions 10*b* of the iron core 10 and the operating portions 3*b* and 4*b*. For example, when the other end portion 10*b* is slightly extended, the other end portion 10*b* can be allowed to further approach the operating portion 3*b* without changing the interval between the operating portion 4*b* and the other end portion 10*b*. On the other hand, when the other end portion 10*b* is slightly bent toward the side of the operating portion 4*b* or when the length of base portion 10*c* is slightly reduced, the interval between the operating portion 4*b* and the other end portion 10*b* can be narrowed without changing the interval between the other end portion 10*b* and the operating portion 3*b*. In the case of widening either one of intervals, this can be also realized by the same manner as mentioned above.

As described above, according to the invention, the shapes and positions of the iron plates 3 and 4 and iron core 10 are determined in such a manner that at least one operating portion 4*b* of the iron plates 3 and 4 is formed at the edge surface of the iron plate 4. Therefore, the interval between one iron plate and the iron core 10 can be relatively easily changed or adjusted.

Figure 2:
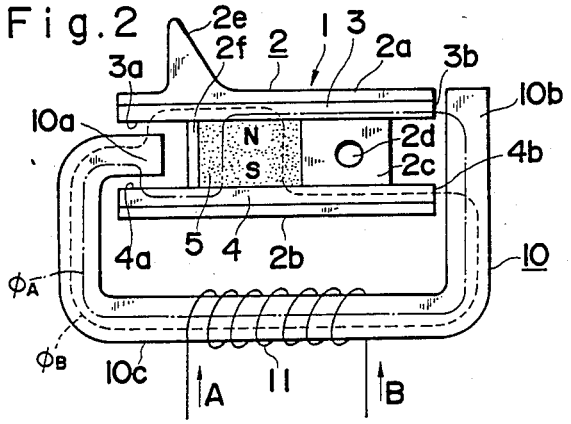
FIG. 2 is a plan view showing the second embodiment.

FIG. 2 shows the second embodiment. In the second embodiment, in order to form the operating portion 3*b* of the iron plate 3 at the edge surface thereof in addition to the operating portion 4*b*, the other edge surface of the iron plate 3 is arranged so as to face the other end portion 10*b* of the iron core 10. The other constitution and operation of the second embodiment are similar to those of the first embodiment.

Figure 3:
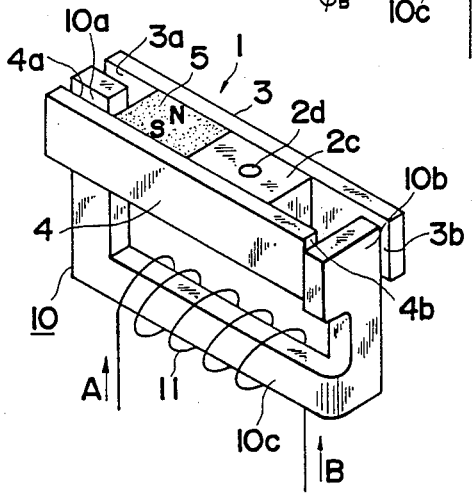
FIG. 3 is a perspective view showing the third embodiment.

FIG. 3 shows the third embodiment. In the first and second embodiments, the base portion 10*c* of the iron core 10 is located along the side of the movable assembly 1 with a predetermined distance kept. However, in the third embodiment, the base portion 10*c* is disposed below the movable assembly 1. The other end portion 10*b* of the iron core 10 is twisted by an angle of 90° with respect of the base portion 10*c* and the width of the other end portion 10*b* is wider than the base portion 10*c*.

The other constitution and operation are similar to those of the first and second embodiments. In FIG. 3, a part of the insulation supporting member 2 is omitted for easily understanding the constitution of the third embodiment.

The first and second embodiments intend to reduce the thickness of electromagnet device by arranging the base portion 10*c* (having the coil 11) of the iron core 10 in parallel with the movable assembly 1 in the horizontal direction. However, in the third embodiment, the width dimension of the apparatus is reduced by vertically arranging the movable assembly 1 and base portion 10*c*.

Figure 4:
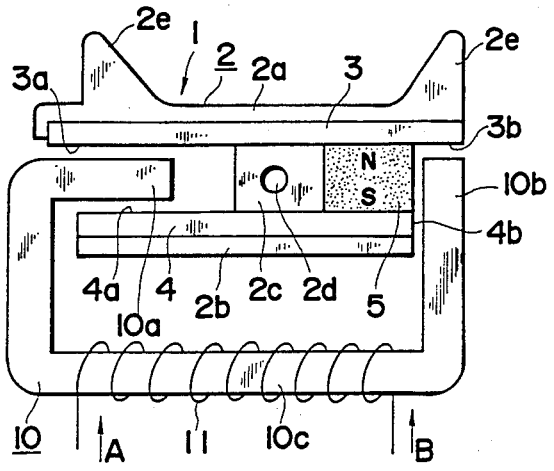
FIG. 4 is a plan view showing the fourth embodiment.

FIG. 4 shows the fourth embodiment. In the first to third embodiments mentioned above, the rotational center (fulcrum portion 2*c*) of the movable assembly 1 is attached to the position near the end portion of the movable assembly 1. In the forth embodiment, the rotational fulcrum 2*c* (hole 2*d*) of the movable assembly 1 is formed in substantially the central portion of the movable assembly 1. Two projections 2*e* adapted to drive the movable contact members are formed at both end portions of the insulation supporting member 2. With this constitution two movable contact members can be alternately driven. The other constitution and operation are similar to the first embodiment.

Figure 5:
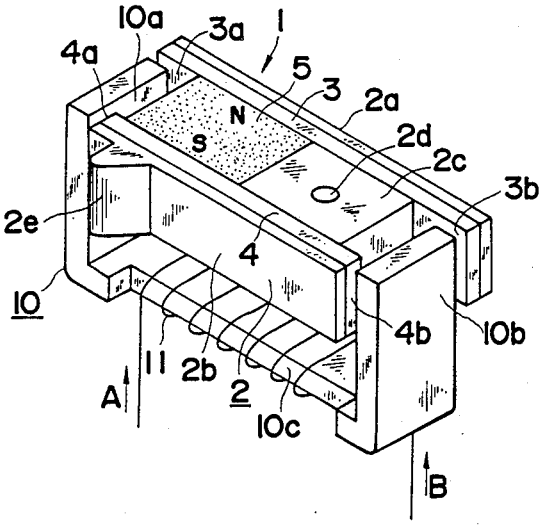
FIG. 5 is a perspective view showing the fifth embodiment.

FIG. 5 shows the fifth embodiment.

In the fifth embodiment, the base portion 10*c* (having the coil 11) of the iron core 10 is disposed below the movable assembly 1 similarly to the third embodiment. In order to form the operating portions 4*a* and 4*b* of the iron plate 4 at the edge surfaces thereof, these edge surfaces are arranged so as to face both end portions 10*a* and 10*b* of the iron core 10, respectively.

A fixing structure of the foregoing electromagnet device will now be described with reference to FIGS. 6 to 9, in particular, with regard to the structure when the electromagnet device is assembled in an electromagnetic relay.

Figure 6:
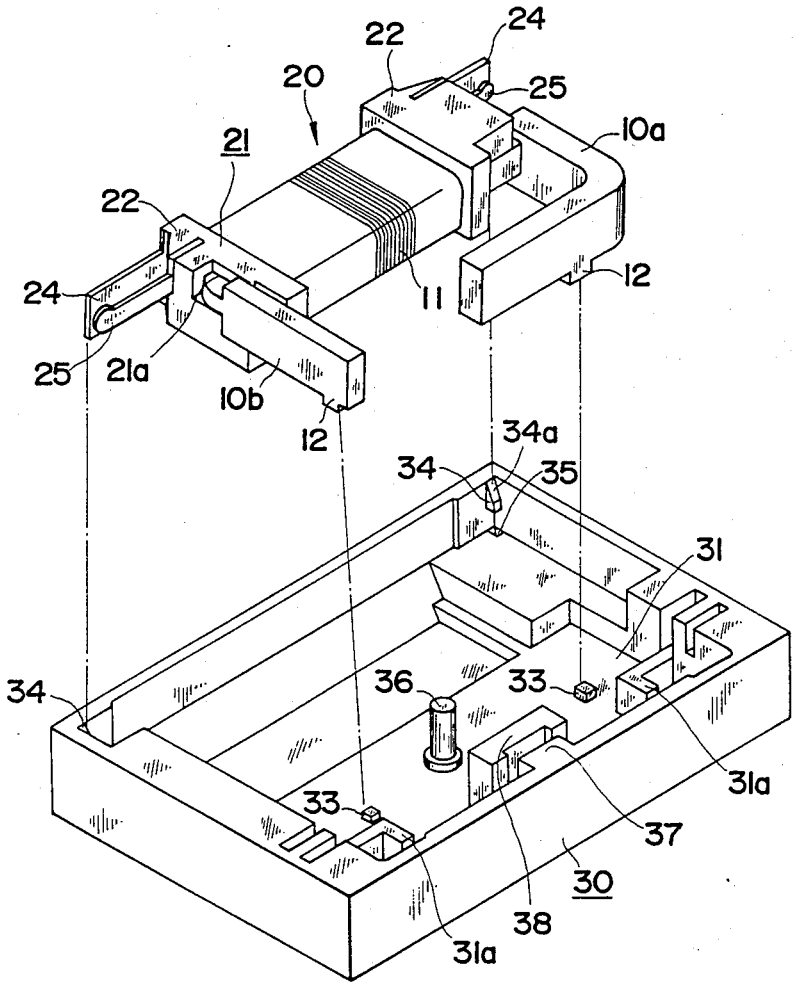
FIG. 6 is an exploded perspective view showing a fixing structure of an electromagnet device.

In FIG. 6, an electromagnet device 20 has a structure similar to that shown in FIG. 4. In FIG. 4, the coil 11 is directly wound around the base portion 10*c* of the iron core 10. However, in the actual apparatus, the coil 11 is wound around the body portion of a spool 21. The spool 21 is made of a synthetic resin and has flanges 22 at both end portions. A hole 21*a* is formed in the spool 21 so as to penetrate the body portion and flanges 22. The base portion 10*c* of the iron core 10 is inserted into the hole 21*a* of the spool 21. Both end portions 10*a* and 10*b* are projected to the outsides of the spool 21. Retaining portions 12 projecting downwardly are integrally formed under the end portions 10*a* and 10*b* of the iron core 10, respectively.

Leaf springs 24 are integrally formed with the flanges 22 of the spool 21 so as to project to both sides, respectively. The leaf springs 24 are formed of the same material as the spool 21. Coil terminals 25 are fixed to the flanges 22. Both ends of the coil 11 are connected to the coil terminals 25.

A base 30 of the electromagnetic relay is also formed of a synthetic resin so as to have a rectangular box shape. A bottom portion 31 of the base 30 has the concave shape adapted to just enclose the electromagnet device 20. The bottom portion 31 is formed with engaging projections 33 at the positions corresponding to the retaining portions 12 of the iron core 10 of the electromagnet device 20, respectively. Projections 34 corresponding to the leaf springs 24 of the electromagnet device 20 are formed in the upper portions at two corners in the base 30. Further, adhesive agent injection holes 35 penetrating the back surface of the base 30 are formed in the base 30 at the positions below the projections 34 (refer also to FIGS. 7 and 8). Upper surfaces 34*a* of the projections 34 are downwardly inclined toward the inside of the base 30.

Figure 7:
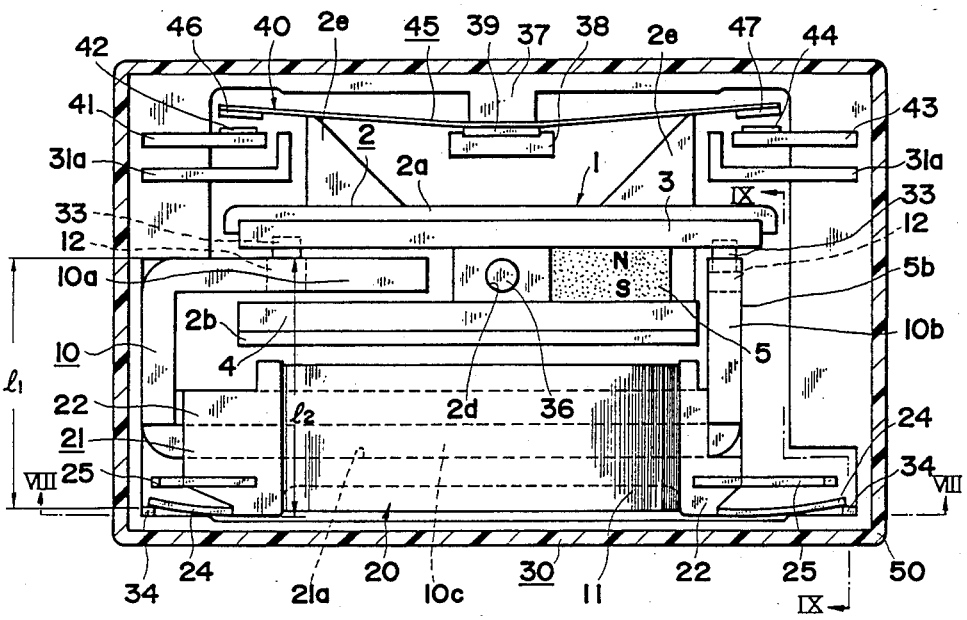
FIG. 7 is a cross sectional view showing an example of an electromagnetic relay to which the fixing structure is applied.

As shown in FIG. 7, the horizontal distance $l_1$ between the surface which is defined by the projections 34 on the base 30 and the opposite surface which is defined by the engaging projections 33 is slightly shorter than the horizontal distance $l_2$ between the outer surface which is defined by the retaining portions 12 of the electromagnet device 20 and the outer surface defined by the leaf springs 24.

Figure 8:
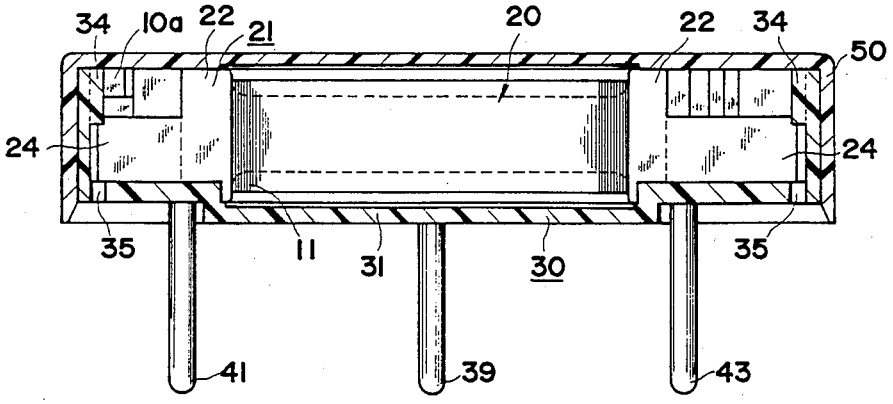
FIG. 8 is a cross sectional view taken along the line VIII—VIII in FIG. 7.

To attach the electromagnet device 20 to the base 30, the device 20 is first inclined and the retaining portions 12 of the iron core 10 come into engagement with the surfaces of the engaging projections 33, which face the projection 34, respectively. Next, in this state, the device 20 is rotated around the engaging projections 33 as the fulcrums such that the spool 21 enters the base 30. The leaf springs 24 are pushed into the base 30 while deforming the leaf springs 24 along the inclined upper surfaces 34*a* of the projections 34. In this manner, the device 20 is set into the concave portion of the bottom portion 31 as illustrated in FIGS. 7 to 9.

Figure 9:
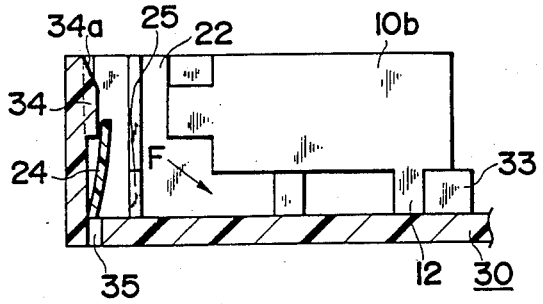
FIG. 9 is a cross sectional view taken along the line IX—IX in FIG. 7.

When the electromagnet device 20 is attached into the base 30, the upper portions of the leaf springs 24 come into contact with the projections 34 and twisted inwardly as shown in FIG. 9. Thus, the device 20 is subjected to the pressing force F which acts obliquely and downwardly by the return forces of the leaf springs 24. Therefore, the position of the device 20 is strongly restricted while preventing the device 20 from floating upward. If necessary, the position of the electromagnet device 20 can be also finely adjusted by moving it.

Subsequently, an adhesive agent is injected from the injection holes 35 of the base 30, thereby adhering and fixing the electromagnet device 20 to the base 30. The injected adhesive agent flows into the gap between the iron core 10 and the bottom portion 31 of the base 30. The flowing of the adhesive agent is stopped in this gap and the adhesive agent does not reach the engaging portions 33.

In this manner, the electromagnet device 20 is unmovably fixed to the base 30. The positional relation between the apparatus 20 and the other parts, particularly, the movable assembly 1 can be accurately determined.

The coil terminals 25 are led to the outside through terminals (not shown, these terminals may be also substituted by parts of the terminals 25) attached to the base 30.

The foregoing movable assembly 1 and a contact mechanism 40 are attached into the base 30. Thereafter, the base 30 is covered by a conver 50 to seal the internal structure.

In particular, with reference to FIGS. 7 and 8, the movable assembly 1 has a structure similar to that shown in FIG. 4 and has two projections 2*e* adapted to drive two portions of the movable contact member 45. A supporting axis 36 which is upwardly projected from the base 30 and a supporting axis (not shown) which is downwardly projected from the cover 50 are inserted into the hole 2*d* of the insulation supporting member 2, thereby rotatably supporting the movable assembly 1 around those supporting axes as the rotational center.

The positional relations among the iron plates 3 and 4 of the movable assembly 1 and the end portions 10*a* and 10*b* of the iron core 10 are as previously explained above.

The contact mechanism 40 comprises: fixed contacts 42 and 44 attached to terminals 41 and 43 which are fixed to the base 30 with a pressure; and movable contacts 46 and 47 attached at both ends of a movable contact member 45 at the positions which face the fixed contacts 42 and 44. One end of each of the terminals 41 and 43 passes through the hole of the base 30 and is projected to the outside of the base.

A common terminal 39 is attached to the central portion of the movable contact member 45. The common terminal 39 passes through the through hole formed in the base 30 and is projected to the outside of the base. The movable contact member 45 together with the common terminal 39 is sandwiched and supported between projections 37 and 38 of the base 30 which are formed at both sides of the above-mentioned through hole. Thus, both end portions of the movable contact member 45 are preliminarily applied with the downward recovery force in FIG. 7, so that they come into pressure contact with the driving projections 2*e* of the movable assembly 1, respectively.

A substantially L-shaped partition wall 31*a* is upwardly projected from the bottom portion 31 of the base 30. On the other hand, another partition wall (not shown) is downwardly projected from the cover 50 at the position corresponding to the partition wall 31*a*. When the cover 50 is overlapped onto the base 30, both partition walls come into contact with each other, thereby forming the integrated partition wall. The distance along the surfaces of the partition wall and so on between the contact mechanism 40 and the movable assembly 1 of the electromagnet device 20, in particular, between the terminals 41 and 43 and the movable iron plate 3 is assurely kept long by the partition wall, thereby providing the good insulation property. The movable iron plate 3 is covered by the side portion 2*a* of the insulation supporting member 2, thereby also improving the insulation property by this constitution.

The operation of the electromagnetic relay will now be described.

FIG. 7 shows a neutral state. When a current is supplied to the coil 11 to excite the N pole in one end portion 10*a* of the iron core 10 and the S pole in the other end portion 10*b*, the repulsive and attractive forces are generated among the end portions 10*a* and 10*b* of the iron core 10 and the iron plate 3 and 4. Thus, the movable assembly 1 rotates clockwise in FIG. 7 around the supporting axis 36 as the fulcrum. The left driving projection 2*e* upwardly pushes the left portion of the movable contact member 45. Therefore, the movable contact 46 is removed from the fixed contact 42. The right projection 2*e* is removed from the right portion of the movable contact member 45. Thus, the right portion of the movable contact member 45 moves by its own spring force so that the movable contact 47 comes into contact with the fixed contact 44. When the supply of the current to the coil 11 is stopped, the movable assembly 1 keeps this state by the magnetic force of the permanent magnet 5.

On the other hand, when a current is supplied to the coil 11 in the direction opposite to the above, the movable assembly 1 rotates counterclockwise. The right driving projection 2*e* presses the right portion of the movable contact member 45 and the movable contact 47 is removed from the fixed contact 44. The movable contact 46 comes into contact with the fixed contact 42. When the supply of current to the coil 11 is stopped, the movable assembly 1 keeps this state as mentioned above.

Although the leaf springs 24 have integrally been formed by the same material as the spool 21 in the above embodiment, the invention is not limited to this constitution. It is also possible to constitute in such a manner that the plate members made of metal or synthetic resin having the spring property which were separately formed are inserted and integrally molded when the spool 21 is molded or that concave portions are formed in the flanges 22 of the spool 21 and the above-mentioned metal plate members or the like are inserted into these concave portions or fixed thereto by an adhesive agent.

Figure 10:
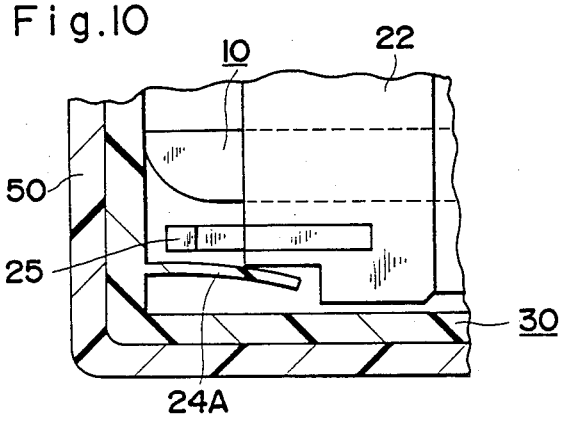
FIG. 10 is a cross sectional view corresponding to a part of FIG. 7 and illustrates a modified form of the fixing structure.
Figure 11:
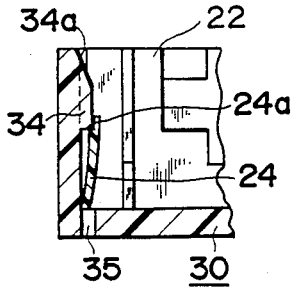
FIG. 11 is a cross sectional view corresponding to FIG. 9 and illustrates still another modified form.

On the other hand, although the leaf springs 24 are attached to the spool 21 in the foregoing embodiment, the invention is not limited to this constitution. The leaf springs 24 may be also attached to the base 30 as indicated at reference numeral 24A in FIG. 10. Further, as shown in FIG. 11, it is also possible to constitute in such a manner that the leaf spring 24 is formed with a stepwise portion 24*a* which can come into engagement with the lower portion of the projection 34, thereby preventing the vertical movement of the leaf spring 24. With such a constitution, the pressing forces of the leaf springs 24 can be allowed to efficiently certainly act on the electromagnet device 20. It is sufficient to use at least one leaf spring 24.

Although the retaining portions 12 of the electromagnet device 20 are attached to the iron core 10 in the foregoing embodiment, the invention is not limited to this constitution. For example, they may be also provided for the spool 21. The retaining portions are not necessarily provided for the iron core 10 or spool 21, but a part of the iron core or spool may also directly come into engagement with the engaging projection 33 of the base 30.

In addition, in the foregoing embodiment, the projecting retaining portions 12 are provided for the electromagnet device 20 and the engaging projections 33 are formed on the base 30 and they come into engagement with one another. However, the invention is not limited to this constitution. Either one of the retaining portion 12 and the engaging projection 33 may be formed as the concave portion.

As described above, according to the fixing structure of the electromagnet device, the electromagnet device comes into engagement with the engaging portions formed on the base and the electromagnet device is pressed to the engaging portions by the spring members attached to either one of the electromagnet device and the base.

Therefore, the electromagnet device can be easily fixed to the base. Since the electromagnet device is pressed to the engaging portions by the spring members and its position is restricted, so that the attaching position and the attaching state of the electromagnet device are accurate. Therefore, the positional relations with the other parts are accurately set and an electric equipment of a high quality can be derived.

What is claimed is:

1. An electromagnet device comprising:

a movable assembly supported swingably and having two magnetic plates which are arranged so as to face each other with a predetermined interval and a permanent magnet arranged between said two magnetic plates, each of said magnetic plates having operating portions in which magnetic poles appear at both end portions of said magnetic plate; and a core having two end portions and around which a coil is wound, both of said end portions being arranged so as to respectively face said operating portions of said magnetic plates, wherein at least one of the operating portions which faces at least one of said end portions of said core is formed at the edge surface of the magnetic plate.

2. An electromagnet device according to claim 1, wherein said movable assembly further includes an insulating member and said insulating member is formed with a projection adapted to drive a movable contact member.

3. A structure to fix the electromagnet device according to claim 1 to a base comprising:

means, provided for said base, for engaging with a part of said electromagnet device; and a spring member, provided for at least either one of said electromagnet device and base, for pressing the electromagnet device toward said engaging means in the state in which the electromagnet device is attached to the base.

* * * * *